United States Patent [19]

Ishikawa

[11] 4,101,266

[45] Jul. 18, 1978

[54] FIRE PREVENTION DEVICE FOR THE FIXING STAGE OF AN ELECTROPHOTOGRAPHIC MACHINE

[75] Inventor: Keiichi Ishikawa, Urawa, Japan

[73] Assignee: Tokyo Shibaura Electric Co., Ltd., Kawasaki, Japan

[21] Appl. No.: 759,552

[22] Filed: Jan. 14, 1977

[51] Int. Cl.[2] ..... H05B 3/00; G03G 8/00; F27B 9/14

[52] U.S. Cl. ..... 432/46; 432/65; 432/59; 219/216; 219/388

[58] Field of Search ..... 432/65, 59, 35, 43, 432/45, 46; 219/216, 388; 49/30, 29; 169/48, 49, 60, 61; 34/1, 41

[56] References Cited

U.S. PATENT DOCUMENTS

| | | | |
|---|---|---|---|
| 3,748,088 | 7/1973 | Mooney et al. | 432/59 |
| 3,778,222 | 12/1973 | Suzuki | 432/59 |
| 3,806,314 | 4/1974 | Obuchi et al. | 432/59 |
| 3,826,014 | 7/1974 | Helding | 34/1 |

*Primary Examiner*—John J. Camby
*Assistant Examiner*—Henry C. Yuen
*Attorney, Agent, or Firm*—Cushman, Darby & Cushman

[57] ABSTRACT

A fire prevention device for a fixing stage of an electrophotographic copying machine includes a heat shield plate movable to close the fixing stage. The heat shield plate may be controlled by a control mechanism having first and second solenoids so that the heat shield plate shuts the fixing stage only when a driving power for the copying machine is stopped or an abnormality is detected in a fixing step, during the copying operation.

11 Claims, 3 Drawing Figures

FIRE PREVENTION DEVICE FOR THE FIXING STAGE OF AN ELECTROPHOTOGRAPHIC MACHINE

BACKGROUND OF THE INVENTION

The present invention relates to a fire prevention device with a heat shield plate for preventing overheat in the fixing stage of an electrophotographic copying machine and more particularly to a fire prevention device with a control mechanism permitting the heat shield plate to be shifted when necessary.

In a known fire prevention device, for example, in the Japanese Publication of No. 12750/50 of Showa (1975), a heat shield plate is normally biased by a coil spring to close the front face of a fixing device. When in use, the front face of the fixing device is opened by removing the heat shield plate against the force of the spring by means of a solenoid. In paper jamming or power stoppage during the fixing operation, the solenoid is deenergized to release the heat shield plate thereby to automatically close the fixing device. In such a construction, it is necessary that the solenoid has a traction force enough to pull the heat shield plate resisting against the spring force and that it has a stroke large enough to open and close the fixing device. Therefore, the solenoid used must be large in size and high in cost and consumes a large electric power.

SUMMARY OF THE INVENTION

Accordingly, an object of the present invention is to provide a fire prevention device for the fixing stage of the electrophotographic copying machine which is operable with a small urging member such as a spring and with a small amount of power dissipation.

DETAILED DESCRIPTION OF THE PREFERRED EMBODIMENTS

The present invention will now be described by using an embodiment thereof and its related drawing. In the specification, some words indicating direction, relative position and the like will be used only in connection with the view of drawing for clearness and brevity.

Figure 1:
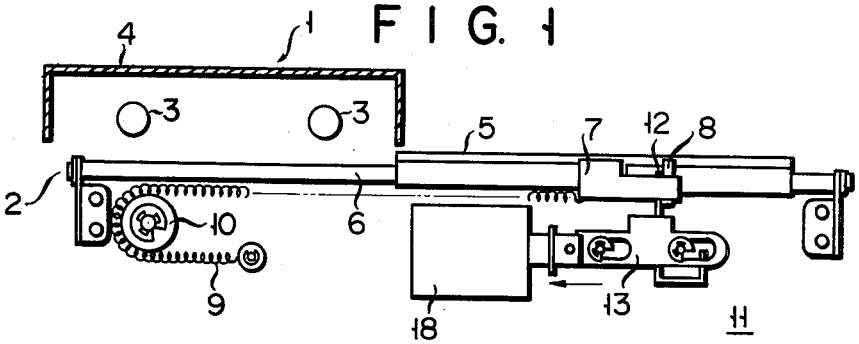
FIG. 1 is a side view, partly broken, of an embodiment of a fire prevention device for a fixing stage of an electrophotographic copying machine according to the present invention.

Referring now to FIG. 1, there is shown an embodiment of a fire prevention device for a fixing stage of an electrophotographic machine of the invention. In the figure, reference numeral 1 designates a fixing device in the fixing stage provided adjacent a copy paper transporting path 2 of the electrophotographic copying machine (not shown). The fixing device is comprised of a box-like reflector 4 opened to the transporting path 2 and heat sources, for example, infrared lamps 3, provided in the reflector 4. The opening of the reflecting box 4 is opened and closed by means of a heat shield plate 5. The shield plate 5 is guided by a guide bar 6 provided along the transporting path 2. When the shield plate 5 is positioned between the opening of the reflector 4 and the transporting path 2, by means of the guide bar 6, it closes the opening of the reflector 4 to shut off the thermal radiation from the lamps 3 to the transporting path 2.

An operation handle 7 is provided at one side of the shield plate 5, and, on the base portion of the handle 7, is provided a stop ring 8 coaxial with guide bar 6. Those components are movable together with the shield plate 5. The handle 7 is U-shaped in cross section and provided at the lower wall with a slant face or cam face 7*a*. A coil spring 9 is fastened at one end to the handle 7 and wound around a reel 10 disposed at the fixing device 1 side, and fixedly supported at the other end by the machine. With such a coil spring connection, the heat shield plate 5 is normally biased to close the opening of the reflector 4 constituting the fixing device 1.

Figure 2:
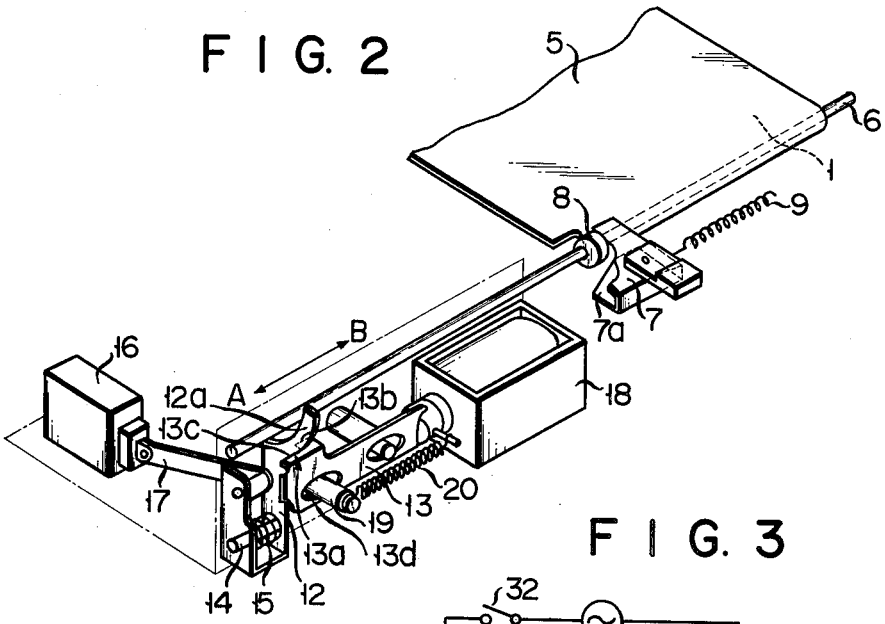
FIG. 2 is a perspective view of a control mechanism for the fire prevention device of FIG. 1.

The movement of the heat shield plate 5 against the spring force is performed by means of a control mechanism 11 cooperating with the handle 7 and the stop ring 8. The control mechanism 11 comprises a first locking member or actuator 12 and a second locking emmber or slide plate 13. The actuator 12, as shown in FIG. 2, is swingably supported at the lower portion by a pin 14 fixed to the machine, permitting the actuator 12 to swing around the pin 14. An arch shaped portion 12*a* partially around the guide bar 6 is formed at the top of the actuator 12 and is normally biased apart from the guide bar 6 by means of a torsion spring 15 coupled between the pin 14 and the actuator 12. The actuator 12 is connected to one end of a coupling bar 17 of which the other end is connected to a first solenoid 16. When the first solenoid is energized, the actuator 12 is swung to move toward the guide bar 6, resisting against the force of the torsion spring 15. At this time, if the stop ring 8 is moved in the direction as indicated by an arrow A and is placed at the position beyond the arch-shaped engaging portion 12*a* of the actuator 12, the engaging portion 12*a* engages the stop ring 8 to block the movement of the stop ring 8, i.e. the heat shield plate 5, in the direction of an arrow B. Therefore, the fixing device 1 remains open. When the first solenoid 16 is deenergized, the torsion spring 15 separates the portion 12*a* from the guide bar 6 and thus stop ring 8, i.e. the shield plate 5, moves in the arrow B direction by the coil spring 9. The result is closing of the fixing device 1.

The slide plate 13 is provided at the top end with a stop 13*a* bent to the engaging portion 12*a* of the actuator 12. The stop 13*a* has a narrower portion 13*c* and a wider portion 13*b*. When the wider portion 13*b* of the stop 13*a* contacts the portion 12*a*, if the first solenoid 16 is deenergized, rotation of the actuator 12 by the spring 15 is blocked thereby to keep the engagement of the portion 12*a* with the stop ring 8. On the other hand, when the narrower portion 13*c* pauses confronting the portion 12*a*, if the first solenoid 16 is deenergized, the spring 15 rotates the actuator 12 to disengage the portion 12*a* from the stop ring 8 with the result that the stop ring 8, i.e. the shield plate 5, is pulled by the coil spring 9 and thus the fixing device is closed. The slide plate 13 is connected at one end with a second solenoid 18. When the second solenoid 18 is energized, the slide plate 13 is moved along the guide bar 6 toward the fixing device 1. A horizontally elongated hole 13*d* is formed on one side of the slide plate 13. A pin 19 fixed to the photocopying machine (not shown) is loosely inserted in the elongated hole 13*d*. A tension spring 20 connected between the pin 19 and the slide plate 13 normally pulls the slide plate 13 to the pin 19, i.e. in the direction opposite to the second solenoid 18. Accordingly, when the second solenoid 18 is deenergized, the slide plate 13 is drawn to the pin 19 by means of the spring 20 and the wider portion 13*b*, or the lock portion, of the stop 13*a*, is placed confronting the portion 12*a* of the actuator 12. On the other hand, when the solenoid 18 is energized, the slide plate 13 is moved against the force of the tension spring 20 toward the solenoid 18 and the narrower portion 13*c* of the stop 13*a* pauses facing the portion 12*a* of the actuator 12.

The first solenoid 16 is energized by ac electric power and the second solenoid 18 by dc electric power. It is during copying operation that both solenoids are energized. The electric circuit for energizing them is shown in FIG. 3.

Figure 3:
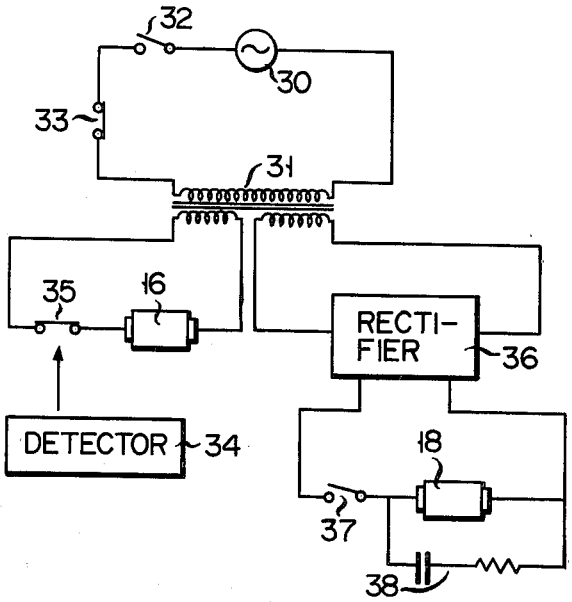
FIG. 3 is a schematic circuit diagram of a drive circuit of the control mechanism.

As shown in FIG. 3, an ac power source 30 is connected across a primary winding of a transformer 31 through a power switch 32 and a door switch 33. The first secondary widing of the transformer 31 is connected in series with a normally close switch 35 and the first solenoid 16. The switch 35 is opened by means of a known abnormality detector 34 for detecting an abnormality of the photocopying operation, for example, paper jamming. The second secondary winding of the transformer 31 is coupled with a rectifier 36 of which the output is connected to a series circuit including a print switch 37 and the second solenoid 18. The second solenoid 18 is connected in parallel with a delay circuit 38 including a capacitor and a resistor for ensuring the deenergization delay of the second solenoid 18 to the first solenoid 16. Generally, the ac solenoid has a higher deenergization speed than the dc solenoid so that, when the power supply to both the solenoids is simultaneously turned off, the ac solenoid is deenergized earlier than the dc solenoid. The deenergization timing between the first and second solenoids is very important in the fire prevention device of the present invention. It is for this reason that the delay circuit 38 is supplementary employed.

The description to follow is the operation of the above-mentioned fire prevention device.

(a) Before the photocopying machine operates:

As shown in FIG. 1, the heat shield plate 5 is placed at the position where the fixing device 1 is open and locked, through the engagement of the stop ring 8 with the portion 12*a* of the actuator 12 and through the action of the wider powetion 13*b* of the stop 13*a*. At this time, the door switch 33 and the abnormality detection switch 35 are in closed condition.

(b) During photocopying operation:

Under the just-mentioned condition, the power switch 32 is turned on. Upon the turning-on, the heat source 3 reaches a predetermined temperature so that the photocopying machine becomes a ready condition, and, at the same time, the first solenoid 16 is energized. Then, the print switch 37 is closed to cause an ordinary photocopying operation and at the same time to energize the second solenoid 18. Those operations mentioned above are the same as the conventional photocopying operations except those of the solenoids 16 and 18. The copy paper bearing the image transferred thereon is fixed by the fixing device 1.

(c) When the power switch 32 is turned off or the power stoppage takes place under the ready condition:

Under this condition, the first solenoid is immediately deenergized but the rotation of the actuator 12 continues to be blocked by the wider portion 13*b* of the stop 13*a* because the second solenoid is kept in its deenergized condition. Thus, the heat shield plate 5 is left locked to maintain its opening position for the reflector 4.

(d) In case where, in photocopying operation through the close of the print switch 37, abnormality takes place and the abnormality detection mechanism 34 causes the switch 35 to open:

The second solenoid 18 has been in an energized condition and thus the slide 13 has been moved in the direction of the arrow B in FIG. 2, against the force of the spring 20. Accordingly, the narrow portion 13*c* of the stop 13*a* of the slide 13 has face the engaging portion 12*a* of the actuator 12, i.e. the actuator has been in non-locking condition. Under this condition, as the switch 35 is opened, the first solenoid 16 is deenergized and the spring 15 rotates the actuator 12 to release the engagement of the stop ring 8 with the engaging portion 12*a*. As a result, the spring 9 pulls the shield plate 5 in the B arrow direction in FIG. 2 so that the shield plate 5 closes the reflector 4 as shown in the figure.

(e) When the power supply, during the photocopying operation, is ceased, as in the case of item (c):

The first and second solenoids 16 and 18 are both deenergized but the former completes earlier its deenergization than the latter. Accordingly, as in the items (d), the engagement of the stop ring 8 with the engaging portion 12*a* is released so that the shield plate 5 moved in the arrow B direction and then the second solenoid 18 is deenergized so that the slide plate 13 moved in the arrow A direction. As a result, the fixing device 1 is closed. With respect to the control mechanism, the arrow A movement of the slide plate 13 is controlled within a predetermined range because the wider portion 13*b* of the stop 13*a* abuts the side surface of the engaging portion 12*a* of the actuator 12, as seen from FIG. 2.

(f) When the shield plate 5 moved through the operation of the items (d) and (e) is reset:

The handle 7 of the shield plate 5 is manually moved along the guide bar 6 in the direction of the arrow A, resisting against the spring 9 force. When the stop ring 8 is moved beyond the engaging portion 12*a* of the actuator 12, the slant cam face 7*a* engages the rear face of the actuator 12 so that the actuator 12 is rotated toward the guide bar 6, resisting against the spring 15 force. As a result, the stop ring 8 engages the engaging portion 12*a* while at the same time the engaging portion 12*a* disengages the stop 13*a* of the slide plate 13. Thus, the slide plate 13 slides in the arrow A by means of the spring 20, and the wider portion 13*b* of the stop 13*a* comes in contact with the rear of the engaging portion 12*a*, resulting in setting-up of the locking condition.

As described above, in the fire prevention device of the present invention, the heat shield plate is surely moved at the abnormal detection and/or power stoppage during the photocopying operation so that the opening of the reflection box 4, i.e. the fixing device 1, is surely closed.

In the embodiment mentioned above, the time difference of deenergizing initiation between the first and second solenoids was produced by using the different type solenoids, the ac solenoid and the dc solenoid. However, if a suitable delay means is used, the same type solenoid, for example, the dc or ac solenoid, may be used. For such a delay means, mechanical delay means as well as electrical one may be used.

Furthermore, the manual operation, to return the shield plate to the reset condition may be substituted by automatic means using the electrical means or the oil pressure means.

From the foregoing description, it will be understood that, the fire prevention device of the present invention permits to use the solenoid having the plunger stroke for shorter than the moving distance of the shield plate. Moreover, the movement of the heat shiled plate is restrictively controlled by the rocking means so that the solenoid with small drive force and small power consumption may be used, thus providing economical and small fire prevention devices.

In the present invention, the heat shiled plate does not shut the reflector only when the copying machine has not been brought to the copying operation, even if the power stoppage is generated. That is, when the copying machine is brought to the ready state, the heat shield plate never shut the reflector during the ready time of the copying machine.

What is claimed is:

1. A fire prevention device for a fixing stage of an electrophotographic copying machine, having an abnormality detection mechanism comprising:

a heat shield plate movable between a first position to close the front face of the fixing stage and a second position to open said front face;

heat shield plate transporting means to normally bias said shield plate to said first position;

first locking means movable between a locking position for holding said heat shield plate at said second position, resisting the force of said transporting means and a non-locking position incapable of holding said plate at said second position;

first energizing means to normally energize said first locking means to maintain said plate at said non-locking position;

a first solenoid which is energized, during the copying operation of the electrophotographic copying machine, to move said first locking means to the locking position, resisting the force of said first energizing means, while said first solenoid is deenergized when said abnormality detection mechanism detects an abnormality;

second locking means movable between a locking position keeping said first locking means at the locking condition and a non-locking position keeping said first locking means in the non-locking condition;

second energizing means normally energizing said second locking means to the locking position;

a second solenoid which is energized, during the copying operation, to bias said second locking means to the non-locking position, resisting said second energizing means; and a power circuit for energizing said first and second solenoids, said first solenoid being deenergized earlier than said second solenoid when the power supply from said power circuit ceases.

2. A fire prevention device according to claim 1, further comprising reset means for returning said heat shield plate positioned at said first position to said second position.

3. A fire prevention device according to claim 2, in which said heat shield plate transporting means includes a guide bar for guiding said heat shield plate therealong and a spring for biasing said heat shield plate to said first position.

4. A fire prevention device according to claim 2, in which said heat shield plate includes an engaging portion which engages said first locking means to hold said heat shield plate at said second position.

5. A fire prevention device according to claim 4, in which said first locking means includes a rotatable actuator with an engaging portion for engaging the engaging portion of said heat shield plate, and said first energizing means includes a spring biasing the engaging portion of said actuator so as to detach from the engaging portion of said shield plate.

6. A fire prevention device according to claim 5, in which said second engaging means is movable along said guide bar and is provided at one end with said second solenoid coupled thereto while at the other end with a slide plate having a stopper portion engaging the engaging portion of said actuator.

7. A fire prevention device according to claim 6, in which said stopper portion is bent to said slide bar and has a wider portion and a narrower portion, said narrower portion being positioned at the other end side with respect to said wider portion, and further said narrower portion confronts the engaging portion of said actuator when said slide plate is at the non-locking position, while said wider portion confronts the same when said slide plate is at the locking position.

8. A fire prevention device according to claim 2, in which said first solenoid comprises an ac solenoid while said second solenoid comprises a dc solenoid.

9. A fire prevention device according to claim 8, wherein said power circuit includes delay means for delaying the deenergizing of the dc solenoid to that of the ac solenoid.

10. A fire prevention device according to claim 2, in which said reset means includes a handle planted in said heat shield plate and has a cam face to move said first locking means to the non-locking position.

11. A fire prevention device for a fixing stage of an electrophotographic copying machine, having an abnormality detection mechanism comprising:

a heat shield plate movable between a first position to close the front face of the fixing stage and a second position to open said front face;

heat shield plate transporting means to move said shield plate to said first position;

first locking means for holding said heat shield plate at said second position;

second locking means for holding said first locking means; and a control means for operating said first and second locking means to bring the shield plate to the first position, when driving power for the copying machine is stopped during a copying operation, and to maintain the shield plate at the second position when driving power is stopped when the copying machine is in a ready condition but a copying operation has not been initiated.

* * * * *